United States Patent [19]

White

[11] 4,448,136

[45] May 15, 1984

[54] BOILER WITH WASTE HEAT RECOVERY

[75] Inventor: Martin White, Kingston upon Thames, England

[73] Assignee: British Gas Corporation, London, England

[21] Appl. No.: 395,267

[22] Filed: Jul. 6, 1982

[30] Foreign Application Priority Data

Aug. 4, 1981 [GB] United Kingdom ..... 8123819

[51] Int. Cl.[3] ..... F22B 1/18; F22D 1/00

[52] U.S. Cl. ..... 122/17; 122/20 B; 237/55; 165/DIG. 2

[58] Field of Search ..... 110/234, 254; 237/55, 237/19; 122/20 B, 17, 13 R; 165/DIG. 2

[56] References Cited

U.S. PATENT DOCUMENTS

| | | | |
|---|---|---|---|
| 3,707,142 | 12/1972 | Kobayashi | 122/17 |
| 3,944,136 | 3/1976 | Huie | 237/55 |
| 4,060,628 | 9/1977 | Konnerth | 165/DIG. 2 |
| 4,090,474 | 5/1978 | Kauffmann | 122/20 B |
| 4,175,518 | 11/1979 | Reams, Jr. | 122/20 B |
| 4,194,488 | 3/1980 | Bellaff | 237/55 |
| 4,227,647 | 10/1980 | Eriksson | 237/55 |
| 4,241,874 | 12/1980 | Schossow | 237/55 |
| 4,280,656 | 7/1981 | Swanson | 122/20 B |
| 4,296,539 | 10/1981 | Asami | 165/179 |
| 4,318,366 | 3/1982 | Tompkins | 122/20 B |

*Primary Examiner*—Henry C. Yuen

*Attorney, Agent, or Firm*—Larson and Taylor

[57] ABSTRACT

A fuel-fired fluid heating appliance, such as a gas-fired boiler (FIG. 1) is provided for heating a fluid such as water circulating in a central heating system. The boiler includes a flue 4 for discharging the combustion products, e.g. exhaust gas, to atmosphere by way of a heat exchanger 8 incorporated within a portion 6 of the flue 4 external of the boiler housing 1. The heat exchanger 8 is provided with an inlet 16 to receive water from a return flow pipe 36 and an outlet 17 to discharge the water to the inlet 35 of the boiler primary heat exchanger 3. The heat exchanger 8 (FIG. 2) is provided with a number of ducts 18 along which the exhaust gas travels to transfer its heat to the water circulating within compartments 29 to 33 within the heat exchanger housing 15. The external portion 6 of the flue 4 is disposed at an angle of 20° downwardly to the horizontal so that any exhaust gas condensing in the heat exchanger 8 flows down the flue base 9 to a discharge spout 10 and collector weir 11. In an alternative arrangement (FIG. 4), the condensate outlet 45 is located at the base of the flue 40 within the boiler, the outlet 45 terminating outside the boiler housing 1. In this case that portion 42 of the flue external of the boiler and incorporating the heat exchanger slopes upwardly at an angle of 20° to the horizontal.

1 Claim, 4 Drawing Figures

BOILER WITH WASTE HEAT RECOVERY

Figure 1:
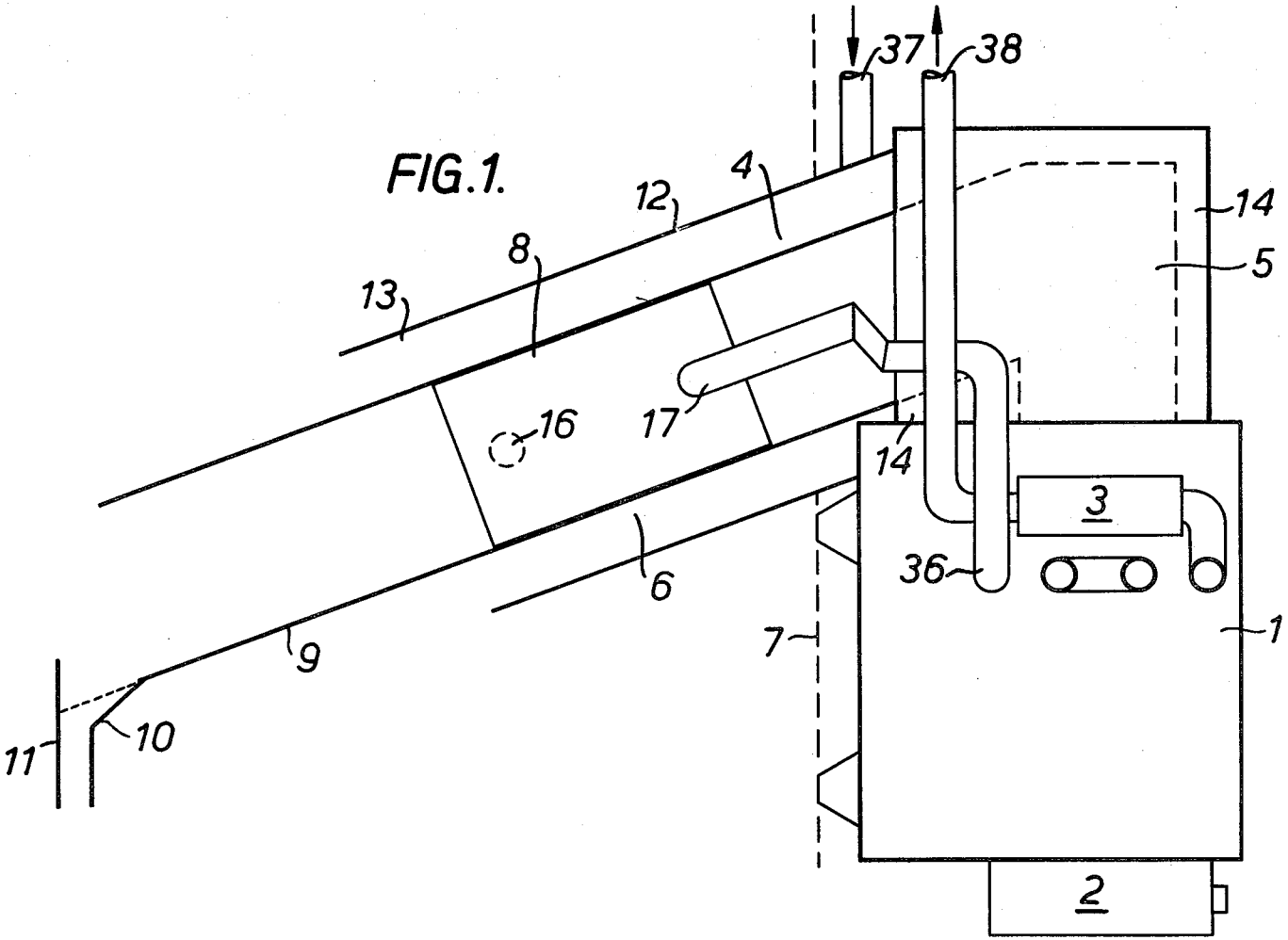

The present invention relates to a fuel-fired heating appliance, particularly to a boiler for heating a circulating fluid as well as to a flue for such an appliance and to a heat exchanger, primarily, but not exclusively, for an appliance of the type defined above.

Recent developments in the design of fuel-fired heating appliances such as domestic central heating boilers have produced a range of appliances which have thermal efficiencies approaching 80% while the appliances themselves may be wall hung and are compact.

It is an object of the present invention to provide appliances which enable this thermal efficiency to be significantly increased.

According to one aspect of the present invention there is provided a fuel-fired fluid heating appliance, the appliance including a flue for discharging the combustion products of the appliance to atmosphere by way of a heat exchanger which is incorporated within the flue to receive fluid for heat exchange with the combustion products to provide preheating or after heating of the fluid respectively before its entry to or after its leaving the appliance, the flue having an outlet for discharging externally of the appliance any combustion products condensing in the heat exchanger during use, the outlet being so disposed as to receive such condensed products by gravity flow from the heat exchanger.

Preferably the flue includes a portion mounted within the appliance and a portion which lies externally of the appliance and which includes the heat exchanger.

In one embodiment of the invention the outlet is located in the flue portion lying externally of the appliance.

Preferably the portion lying externally of the appliance slopes at an angle downwardly away from the vertical axis of the appliance.

Suitably the external flue portion terminates in the outlet.

Conveniently the outlet is a discharge spout.

In another embodiment of the invention the outlet is located in the flue portion which is mounted within the appliance.

Preferably the outlet is located at the base of the flue portion mounted within the appliance.

Suitably the outlet comprises a trap for the condensed combustion products.

Conveniently the flue portion lying externally of the appliance is at an angle sloping upwardly away from the vertical axis of the appliance.

Preferably the appliance includes an air intake duct forming a shroud for part at least of a flue portion which is external of the appliance so that air drawn into the duct can travel through the passageway formed between the duct and the flue portion.

Suitably the heat exchanger comprises a sealed housing having an inlet to receive the fluid and an outlet to discharge the fluid and a plurality of ducts extending through the housing to receive and discharge the combustion products.

Conveniently the ducts have means within their bores for causing the combustion products to be directed radially outwardly towards the internal wall of the ducts as the combustion products flow along the bores.

Preferably the means within the duct bores comprise fins extending axially along the duct and radially from the internal wall of the duct.

Suitably the fins meet each other at a central point.

Conveniently the fins are in the form of a star-type insert.

Preferably the housing is provided internally with at least two interconnected compartments through which each duct extends, there being at one end of the housing a compartment to receive fluid and at the other end of the housing a compartment to discharge fluid, adjacent compartments being arranged so that the fluid flows therethrough in opposite directions.

Suitably the compartments are formed by baffle means through which each duct extends.

According to another aspect of the present invention, there is provided a flue for a fuel-fired fluid heating appliance, the flue including a heat exchanger for receiving the combustion products leaving the appliance before their discharge to atmosphere by way of the heat exchanger, the heat exchanger being adapted to receive fluid for heat exchange with the combustion products to provide preheating or afterheating of the fluid respectively before its entry to or after its leaving the appliance and an outlet for discharging externally of the appliance any combustion products condensing in the heat exchanger during use, the outlet being so disposed as to receive such condensed products by gravity flow from the heat exchanger.

Preferably the flue includes a portion for mounting within the appliance and a portion which is to lie externally of the appliance and including the heat exchanger.

In one embodiment of the invention, the outlet is located in the flue portion which is to lie externally of the appliance.

Preferably the portion which is to lie externally of the appliance is at an acute angle to the portion which is to be mounted with the appliance.

Suitably the flue portion which is to lie externally of the appliance terminates in the outlet.

Conveniently the outlet is a discharge spout.

In another embodiment of the invention the outlet is located in the flue portion which is to be mounted within the appliance.

Preferably the outlet is located in the flue portion which is to be mounted within the appliance.

Suitably the outlet comprises a trap for the condensed combustion products.

Conveniently the flue portion which is to lie externally of the appliance is at an oblique angle to the portion which is to be mounted within the appliance.

Preferably the heat exchanger comprises a sealed housing having an inlet to receive the fluid and an outlet to discharge the fluid and a plurality of ducts extending through the housing to receive and discharge the combustion products.

Suitably the ducts have means within their bores for causing the combustion products to be directed radially outwardly towards the internal wall of the ducts as combustion products flow along the bores.

Conveniently the means within the duct bores comprise fins extending axially along the duct and radially from the internal wall of the duct.

Preferably the fins meet each other at a central point.

Suitably the fins are in the form of a star-type insert.

Conveniently the housing of the heat exchanger is provided internally with at least two interconnected compartments through which each duct extends, there being at one end of the housing a compartment to receive fluid and at the other end of the housing a compartment to discharge fluid, adjacent compartments being arranged so that the fluid flows therethrough in opposite directions.

Preferably the compartments are formed by baffle means through which each duct extends.

According to a further aspect of the present invention, there is provided a heat exchanger comprising a sealed housing having an inlet to receive a first fluid for circulation within the housing and an outlet for discharge of the first fluid and a plurality of ducts extending through the housing to receive and discharge a second fluid which is selected, in use, to be at a higher temperature than the first fluid so as to transfer heat thereto.

Preferably the ducts have means within their bores for causing the second fluid to be directed radially outwardly towards the internal walls of the ducts as the second fluid flows along the bores.

Suitably the means within the duct bores comprise fins extending axially along the duct and radially from the internal wall of the duct.

Conveniently the fins are in the form of a star-type insert.

Desirably the fins meet each other at a central point.

Preferably the housing of the heat exchanger is provided internally with at least two interconnected compartments through which each duct extends, there being at one end of the housing a compartment to receive fluid and at the other end of the housing a compartment to discharge fluid, adjacent compartments being arranged so that the fluid flows therethrough in opposite directions.

Suitably the compartments are formed by baffle means through which each duct extends.

Figure 2:
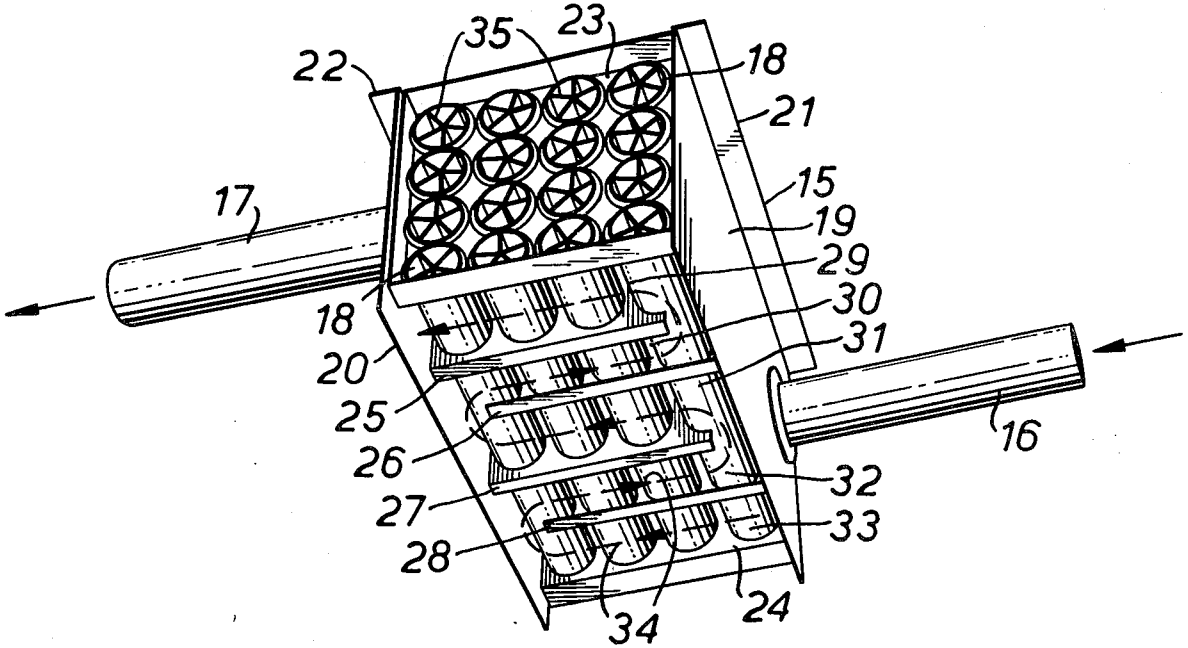
Figure 3:
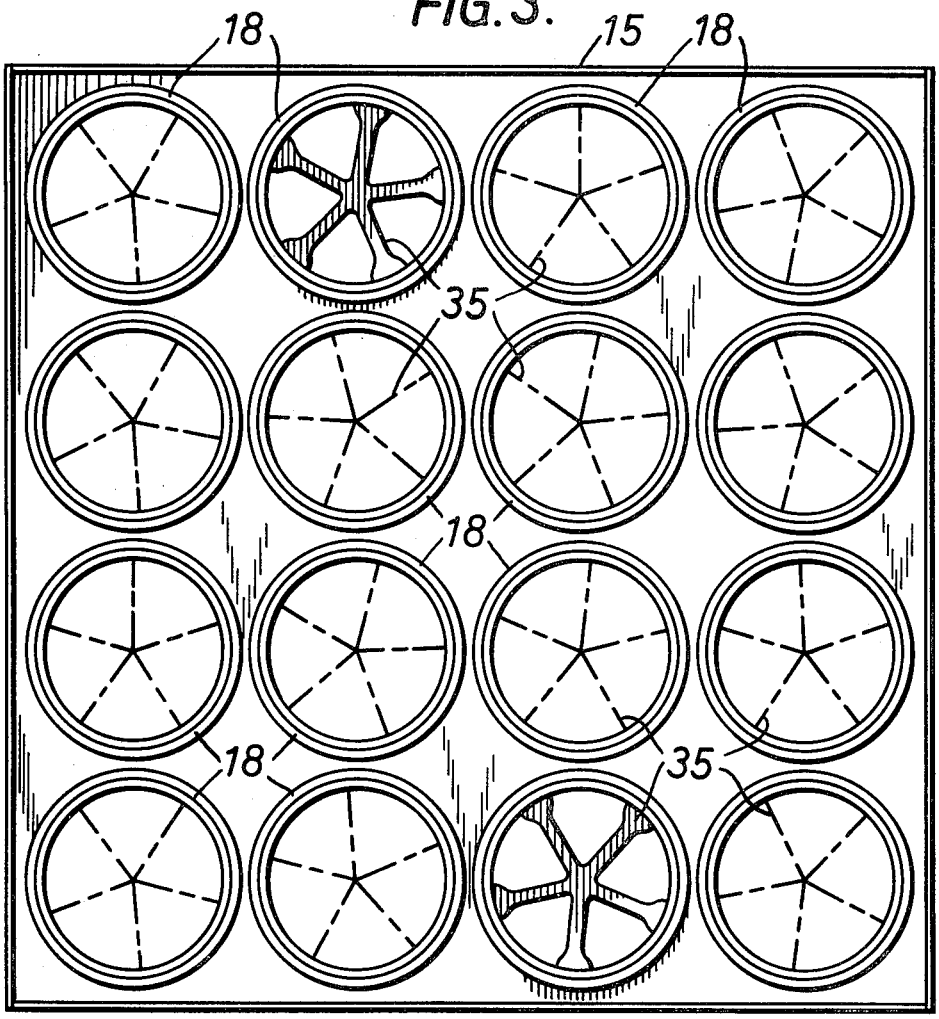
Figure 4:
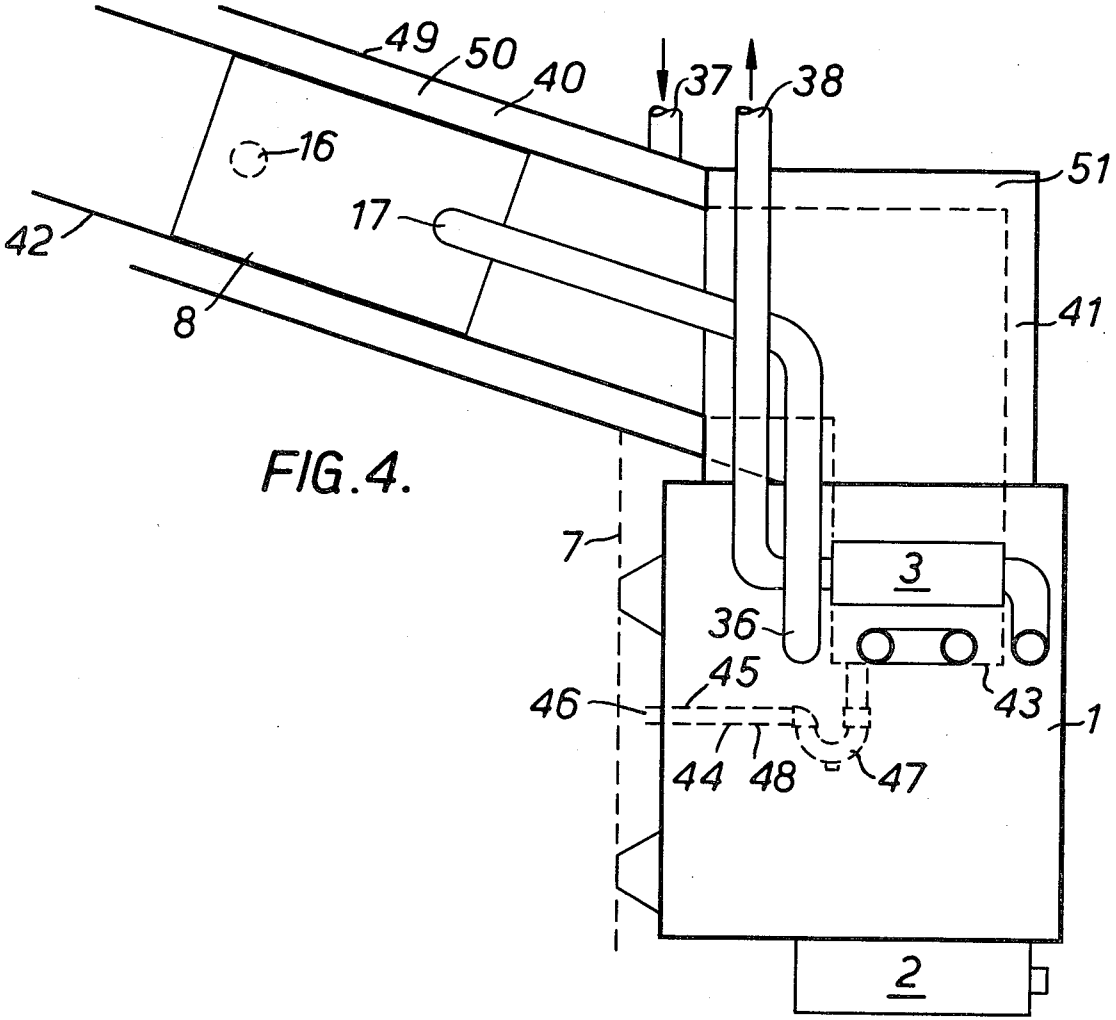

Embodiments of the invention will now be described by way of example only with reference to the drawings in which:

FIG. 1 is a schematic side view showing the interior of a suitable fuel-fired fluid heating appliance, in this case a boiler and its flue, FIG. 2 is a perspective view of the heat exchanger with one side removed, FIG. 3 is a front view of the heat exchanger and FIG. 4 is a schematic side view of a boiler similar to that shown in FIG. 1 but with a different type of flue.

The boiler shown in FIG. 1 is a conventional low thermal capacity forced draught gas fired appliance for use in domestic central heating, the boiler having spark ignition (not shown) and a partially aerated burner (not shown) located in the boiler housing 1. The boiler has a conventional control box 2 located underneath the housing 1, and a conventional primary heat exchanger 3 also located within the housing 1.

The boiler shown in FIG. 1 has a rectangular steel flue 4 for discharge of the boiler exhaust gas combustion products to atmosphere, a part 5 of which flue 4 is mounted within and extends vertically upwardly within the housing 1 as conventional. A further portion 6 of the flue 4 extends outwardly externally from the housing 1 and through the boiler back-plate 7. The flue portion 6 incorporates a heat exchanger 8 which is mounted within the portion 6. The heat exchanger 8 and its operation will be described in detail subsequently. The flue portion 6 is arranged to slope downwardly from the vertical axis of the part 5 and therefore to the vertical axis of the boiler housing 1 at an angle of 70°. In other words the flue portion 6 is arranged at an angle of 20° to the horizontal. The base 9 of the flue portion 6 terminates at its free end in a discharge spout or funnel 10 through which exhaust gas combustion products condensing in the heat exchanger 8 discharge after gravity flow down the flue base 9. The end of the base 9 is formed with a vertically extending weir 11 which serves to trap the condensate before discharge. While not shown the spout 10 is connected to an external drain to drain the condensate away.

The flue 4 forms part of a so called "balanced flue" arrangement which comprises not only the flue 4 but also an air intake duct 12 which is a rectangular steel construction concentric with the external flue portion 6 and extending outwardly from the boiler housing 1 and through the back-plate 7. As shown the air-intake duct 12 terminates short of the flue portion 6 and forms an external passageway 13 therewith for the supply of combustion air to the boiler burners.

An internal air passageway 14 contiguous with the external passageway 13 is formed within the boiler housing between the wall of the flue 4 and the wall of the housing 1 as conventional and this internal passageway delivers air vertically downwards to the burner which while not shown is located just beneath the primary heat exchanger 3. While not shown the boiler housing also contains an electrically operated fan to assist in drawing air in through the passageways to promote combustion of burner gas; the fan also serves to drive the exhaust gas out through the flue 4.

Referring to FIGS. 2 and 3 the heat exchanger 8 comprises a housing 15 having an inlet pipe 16 and an outlet pipe 17 respectively to receive water and discharge it after circulation within the housing 15 and a number of ducts or tubes 18 to receive and discharge exhaust gas for heat exchange with the water.

The housing 15 comprises a four sided rectangular box the base side being removed to permit the housing interior to be viewed and the top side to be subsequently attached. The two side walls 19 and 20 are provided with flanges 21 and 22 along an edge so as to permit the heat exchanger to be located in the flue portion 6. The base and top sides are subsequently soldered into position to seal the housing 15.

Located within the housing 15 are sixteen tubes 18 arranged in an in-line square pitch design and whose ends are located within suitable apertures in two flanged end plates 23 and 24 secured to the box sides so as to maintain the tubes 18 in position. As shown in FIG. 3 spaces are left between the tubes 18 to permit water to pass freely between the tubes.

Also located within the housing 15 are four baffle plates 25 to 28 which form five compartments 29 to 33 within the housing for water circulation. Baffles 25 and 27 terminate short of side wall 19 and baffles 26 and 28 terminate short of side wall 20 so that openings are formed between compartments to enable water to circulate between compartments whilst changing its direction of flow between adjacent compartments for more efficient heat transfer as shown by the arrow 34. The tubes 18 extend through suitable apertures in the baffles or alternatively are located within semi-circular recesses formed at the edges near the openings. The inlet pipe 16 extends from side wall 19 at a position adjacent compartment 33 whilst the outlet pipe 17 extends from side wall 20 at a position adjacent compartment 29.

The hot exhaust gases which pass along the flue portion 6 are caused to enter and pass along inside the tubes 18 so that the gases transfer their heat to the water circulating within the housing 1. In order to increase such heat transfer, each tube 18 is provided with a metal insert 35 (as shown in FIG. 3) which is in the form of a star and extends along the tube bore from one end to the other. The metal insert 35 will both increase the heat transfer surface area available and also cause the gases to be scrubbed against the water cooled walls of the tubes so as to promote partial condensation of the exhaust gases.

All the materials in the heat exchanger are copper because of its high thermal conductivity but the inserts 35 can be of aluminium.

In use of the heat heat exchanger, the water is caused to flow counter to the gas flow, that is, cooled return water entering the heat exchanger via the inlet from the closed system is heated by exhaust gases about to leave the tubes while water about to leave the heat exchanger is heated by the exhaust gases entering the tubes.

Other forms of tube array differing from that shown are possible. For instance the tubes could be arranged in a circular formation as a staggered tube bundle so that the array is more compact.

Referring to FIG. 1 again, in practice the inlet and outlet pipes of the heat exchanger 8 are caused to extend through the walls of the flue 6, through suitable apertures therein. In use, the outlet pipe 17 is connected to the inlet pipe 36 of the boiler primary heat exchanger 3. The inlet pipe 16 is connected to the return water pipe 37 of the fluid circulating system which may be a conventional domestic central heating system. As conventional the outlet of the primary heat exchanger 3 is connected to the flow water pipe 38 of the system.

In the conventional central heating boiler shown in FIG. 1 the hot flue gases release most of their energy to the primary heat exchanger 3. They then pass into the flue 4 and thence to the secondary heat exchanger 8 in the flue porton 6. This takes place in counterflow to the central heating water and so the flue gases cool off in the process to the temperature of the incoming water. The exhaust gas condensate which forms flows along the flue base 9 and is directed into the spout 10 via the weir 11.

The condensate may then be discharged via a syphon into a drain.

Referring to FIG. 4 where parts identical to those shown in FIG. 1 bear the same reference numerals, the boiler has a rectangular steel flue 40 a part 41 of which flue 40 is mounted within and extends vertically upwardly within the boiler housing 1. A further portion 42 of the flue 40 extends outwardly from the housing 1 and through the boiler back-plate 7. The flue portion 42 incorporates a heat-exchanger 8 mounted within the flue portion 42 and identical in construction and operation to that shown in, and described with reference to, the earlier figures. The flue portion 42 is arranged to slope upwardly at an obtuse angle the vertical axis of the flue part 41 and therefore at an obtuse angle to the vertical axis of the boiler housing 1, the angle being 110° to the vertical.

The vertical flue part 41 is closed at its lower end by an apertured plate 43 which communicates which an outlet 44 in the form of a pipe 45 forming a trap for any exhaust gas combustion products which condense in the heat exchanger 8. These products are caused to flow down the flue 40 under gravity towards the pipe 45 which terminates in a discharge end 46 externally of the boiler housing 1. The pipe 45 is formed with a U-shaped bend 47 to trap the condensate and a horizontal part 48 which terminates in the discharge end 46 and along which condensate flows out of the boiler.

As with the arrangement shown in FIG. 1 the flue 40 forms part of a "balanced flue" arrangement comprising not only the flue 40 but also an air intake duct 49 which is a rectangular steel construction concentric with the external flue portion 42 and extending outwardly from the boiler housing 1 and through the back plate 7. As with the arrangement shown in FIG. 1, the air-intake duct 49 terminates short of the flue portion 42 and forms an external passageway 50 therewith for the supply of combustion air to the boiler burners.

An internal air passageway 51 contiguous with the passageway 50 is formed within the boiler housing in a like manner to the boiler shown in FIG. 1 and the "balanced flue" arrangement in FIG. 4 operates in a manner similar to the arrangement shown in FIG. 1.

As with the arrangement shown in FIG. 1, the inlet and outlet pipes of the heat exchanger 8 in FIG. 4 are caused to extend through the walls of the flue 40 through suitable apertures therein and are connected to the relevant pipes 36 and 37, the arrangement after connection functioning in a manner similar to that previously described for the arrangement of FIG. 1.

Condensate leaving the outlet pipe 45 may be discharged directly into a drain.

By incorporating the secondary heat exchanger described into a balanced type flue from which condensate can be drained off it has been possible to increase the thermal efficiency of a conventional boiler from 80% to 91%.

While the flue arrangement described is primarily intended to be incorporated into a boiler, it may also be used with advantage in other types of fuel-fired fluid heating appliances such as instantaneous hot water type heaters. In this case the cold water supply inlet may be connected to the flue heat exchanger so that the flue heat exchanger can preheat the water before it enters the main heating appliance by way of the heat exchanger outlet for its main heating by the heating appliance.

I claim:

1. A fuel fired boiler for heating circulating water, the boiler comprising a housing, a burner and a primary heat exchanger disposed in said housing, a flue extending from the upper end of said housing, a secondary heat exchanger disposed within said flue, a fluid circulating system including piping for circulating fluid through said secondary heat exchanger to said primary heat exchanger, an outlet comprising a discharge spout for said flue for discharging externally of the housing any flue gas condensate formed in the secondary heat exchanger during use, the outlet being disposed in relation to the secondary heat exchanger so as to receive condensate from said secondary heat exchanger by gravity flow and being disposed at the outer end of the flue portion lying external of the housing, an air intake duct forming a shroud for at least a portion of said flue external of said boiler housing, and a passageway within said housing for delivering air from said air intake duct to said burner whereby air passing through said air intake duct is preheated by the flue gas prior to delivery to the burner.

* * * * *